US012258699B2

(12) United States Patent
Rajendran

(10) Patent No.: US 12,258,699 B2
(45) Date of Patent: Mar. 25, 2025

(54) HEAT EXCHANGER CLEANING SYSTEM FOR LAUNDRY APPLIANCE

(71) Applicant: WHIRLPOOL CORPORATION, Benton Harbor, MI (US)

(72) Inventor: Arun Rajendran, St. Joseph, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 1 day.

(21) Appl. No.: 18/101,386

(22) Filed: Jan. 25, 2023

(65) Prior Publication Data

US 2024/0247889 A1 Jul. 25, 2024

(51) Int. Cl.

| | |
|---|---|
| ***D06F 58/24*** | (2006.01) |
| ***D06F 58/20*** | (2006.01) |
| ***D06F 58/22*** | (2006.01) |
| ***D06F 58/45*** | (2020.01) |
| ***F28G 9/00*** | (2006.01) |
| *D06F 103/50* | (2020.01) |

(52) U.S. Cl.
CPC ..... *D06F 58/24* (2013.01); *D06F 58/206* (2013.01); *D06F 58/22* (2013.01); *D06F 58/45* (2020.02); *F28G 9/00* (2013.01); *D06F 2103/50* (2020.02)

(58) Field of Classification Search
CPC ..... D06F 58/206; D06F 58/22; D06F 58/24; D06F 58/45; D06F 2103/50; F28G 9/00
See application file for complete search history.

(56) References Cited

U.S. PATENT DOCUMENTS

| | | | | |
|---|---|---|---|---|
| 2005/0204755 | A1* | 9/2005 | Nishiwaki | D06F 58/206 62/93 |
| 2010/0101606 | A1 | 4/2010 | Grunert | |
| 2014/0190032 | A1 | 7/2014 | Lee et al. | |
| 2017/0010047 | A1* | 1/2017 | Lv | F28D 9/02 |
| 2020/0095722 | A1* | 3/2020 | Yao | D06F 58/24 |
| 2021/0262150 | A1* | 8/2021 | Lee | F04D 29/007 |

FOREIGN PATENT DOCUMENTS

| | | | | |
|---|---|---|---|---|
| CN | 104011285 | A * | 8/2014 | D06F 58/206 |
| CN | 112923783 | A * | 6/2021 | |
| DE | 3738031 | A1 | 5/1989 | |
| DE | 102006018469 | A1 | 10/2007 | |
| DE | 102010031265 | A1 | 1/2012 | |
| DE | 102019107275 | A1 | 9/2020 | |
| EP | 3237674 | B1 | 12/2014 | |
| EP | 3234254 | A1 | 10/2017 | |

(Continued)

OTHER PUBLICATIONS

Machine translation of CN 112923783 A to Xie et al. (Year: 2021).*

(Continued)

*Primary Examiner* — Joseph L. Perrin
(74) *Attorney, Agent, or Firm* — Brooks Kushman, P.C.

(57) ABSTRACT

A laundry appliance may include a blower configured to deliver exhausted air through an airflow path, a heat exchanger arranged within the airflow path and configured to dehumidify the exhausted air, a drain channel configured to receive condensate from the heat exchanger, a cleaning block arranged above the heat exchanger and configured to deliver fluid flow over the heat exchanger to clean the heat exchanger.

10 Claims, 7 Drawing Sheets

(56) References Cited

FOREIGN PATENT DOCUMENTS

| | | | | | |
|---|---|---|---|---|---|
| EP | 3868949 | A1 | * | 8/2021 | ..... D06F 37/263 |
| JP | 2005224491 | A | * | 8/2005 | |
| WO | 2013186114 | A1 | | 12/2013 | |
| WO | 2014040923 | A1 | | 3/2014 | |
| WO | 2017039298 | A1 | | 3/2017 | |
| WO | 2017101616 | A1 | | 6/2017 | |
| WO | WO-2018014822 | A1 | * | 1/2018 | |
| WO | 2021164863 | A1 | | 8/2021 | |
| WO | 2021182767 | A1 | | 9/2021 | |

OTHER PUBLICATIONS

Machine translation of JP 2005224491 A to Nishibatake et al. (Year: 2005).*
Machine translation of WO 2018014822 A1 to Shan et al. (Year: 2018).*
Machine translation of CN 104011285 A to Furubayashi et al. (Year: 2014).*

* cited by examiner

HEAT EXCHANGER CLEANING SYSTEM FOR LAUNDRY APPLIANCE

TECHNICAL FIELD

Disclosed herein are approaches for cleaning a heat exchanger of a laundry appliance.

BACKGROUND

Laundry treating appliances, such as clothes washers, clothes dryers, and refreshers, for example, may have a configuration based on a rotating drum that defines a treating chamber in which laundry items are placed for treating according to a cycle of operation. The laundry treating appliance may include a heat exchanger system for dehumidifying air during a dry cycle. The heat exchanger removes condensate from the air.

SUMMARY

A laundry appliance may include a blower configured to deliver exhausted air through an airflow path, a heat exchanger arranged within the airflow path and configured to dehumidify the exhausted air, a drain channel configured to receive condensate from the heat exchanger, a cleaning block arranged above the heat exchanger and configured to deliver fluid flow over the heat exchanger to clean the heat exchanger.

A cleaning device for a heat exchanger of a laundry appliance, may include a cleaning block having a hollow interior and defining a plurality of openings on a bottom side and configured to be selectively arranged above the heat exchanger within the laundry appliance, a hose configured to attach to an inlet of the cleaning block at one end and to a water supply at the other end, wherein the hose and water supply are at least partially external to the laundry appliance, a valve arranged on the hose and configured to selectively control the water supply to the cleaning block, and a dispenser fluidly connected to the hose to deliver cleaning solution to the water supply prior to the water supply being received by the cleaning block creating a fluid solution delivered to the heat exchanger via the openings.

A method for cleaning a heat exchanger of a laundry appliance may include receiving a fluid solution at a cleaning block arranged above the heat exchanger, delivering a fluid flow over the heat exchanger to clean debris from the heat exchanger, removing residual fluid and debris with a drain pump arranged below the heat exchanger, receiving additional fluid at the cleaning block, and delivering the additional fluid to the heat exchanger for further cleaning.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

Figure 1:
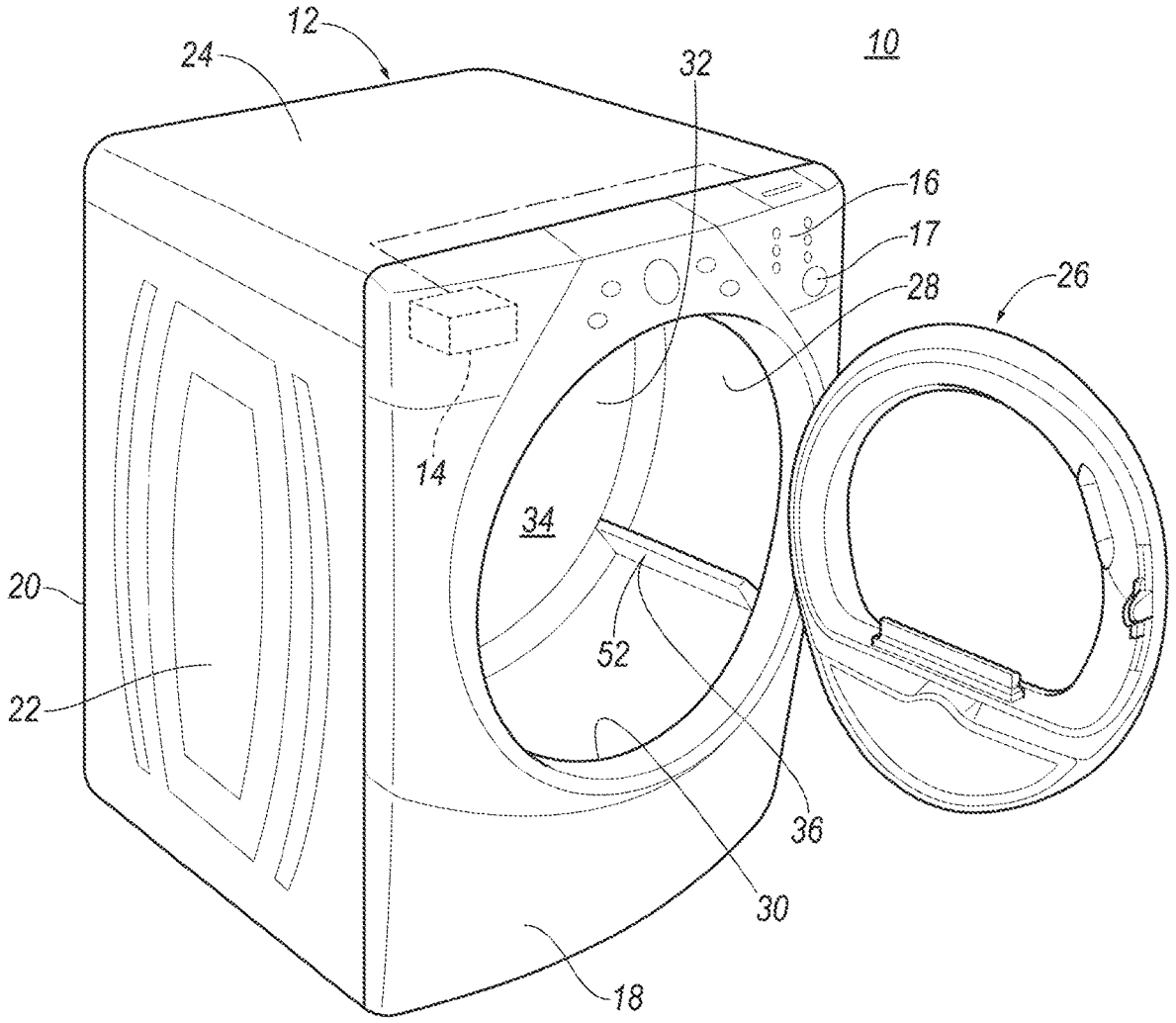
FIG. 1 is a front perspective view of a clothes dryer.

As required, detailed embodiments of the present disclosure are disclosed herein; however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

A dryer may include a heat exchanger to remove condensate from air used to dry laundry within a drum of the laundry appliance. However, heat exchangers may often collect lint and other debris and require cleaning. Often times such cleaning is done by a service technician. In other situations, an inbuild cleaning cycle may be used. However, such cleaning may degrade the efficiency of the heat exchanger or the laundry appliance itself. In some examples, an additional filter is placed in front of the heat exchanger to aid in catching debris prior to the air being received at the heat exchanger.

Described herein is a system that allows for efficient cleaning of the heat exchanger. This system may include adding a cleaning block above the heat exchanger to deliver fluid to the heat exchanger in place of a dead block. This cleaning block may be selectively removable via a door in the front of the appliance by a service technician. The dead block may have an inlet configured to receive fluid. The fluid may be received from a hose configured to mix fluid such as water with a cleaning solution. At an underside of the block, several openings are defined to allow the fluid concentration to flow therefrom. The outlets are arranged so as to allow the fluid flow to generally and uniformly cover the heat exchanger.

In one example, the cleaning solution may be attached to the hose via a special threaded connection and may be individually dosed for a single machine clean. The hose may include a valve to control the water flow and may be selectively actuated by the technician. Once the fluid solution is delivered to the heat exchanger, the residual liquid may be received by a drain channel arranged below the heat exchanger. A pump at the channel may be activated, either automatically or by the technician, and the pump may discard the liquid either via a drain or a condensate collecting bottle. The heat exchanger may then be further flushed with fluid from the water source. The cleaning steps may be repeated until the heat exchanger is free of debris. The technician may then remove the cleaning block, replace the dead block, and the laundry appliance may be used by the user for its normal use.

In addition to the above, the cleaning block may be built into the machine above the heat exchanger. The appliance may include a compartment for housing concentrated cleaning solution similar to bulk dispensing. The appliance may be capable of performing a special cleaning cycle available in the machine where the user selects to perform the heat exchanger cleaning. The fluid may be supplied from inlet valve or recirculated from the condensate collecting bottle.

In the example of a water source, when the cleaning cycle is selected, an inlet valve opens and allows water to flow through a prescribed path and the dispenser pump is turned on allowing the concentrated cleaning solution to dosed in the water steam. The solution is then sprayed over the heat exchanger via the cleaning block. The condensate collection bottle may be partitioned into two segments to prevent mixing of clean water and fouled water. Water is pumped from the bottle into the functional block and in parallel the concentrated cleaning solution is pumped into water stream. Similar to above, the solution is sprayed over the heat exchanger.

FIG. 1 illustrates one embodiment of a laundry treating appliance in the form of a clothes dryer 10 according to aspects of the present disclosure. While the laundry treating appliance is illustrated as a front-loading dryer, the laundry treating appliance according to aspects of the present disclosure may be another appliance which performs a cycle of operation on laundry, non-limiting examples of which include a top-loading dryer, a combination washing machine and dryer; a tumbling or stationary refreshing/revitalizing machine; an extractor; a non-aqueous washing apparatus; and a revitalizing machine.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation. The clothes dryer 10 will offer the user a number of pre-programmed cycles of operation to choose from, and each pre-programmed cycle of operation may have any number of adjustable cycle modifiers. Examples of such modifiers include, but are not limited to chemistry dispensing, load size, a load color, and/or a load type. In one example, a specific cleaning cycle button 17 may be included.

The cabinet 12 may be defined by a chassis or frame supporting a front wall 18, a rear wall 20, and a pair of side walls 22 supporting a top wall 24. A door 26 may be hingedly mounted to the front wall 18 and may be selectively moveable between opened and closed positions to close an opening in the front wall 18, which provides access to the interior of the cabinet 12.

A rotatable drum 28 may be disposed within the interior of the cabinet 12 between opposing front and rear bulkheads 30 and 32, which collectively define a treating chamber 34 having an open face that may be selectively closed by the door 26. The drum 28 may include at least one baffle or lifter 36. In most clothes dryers 10, there are multiple lifters 36. The lifters 36 may be located along the inner surface of the drum 28 defining an interior circumference of the drum 28. The lifters 36 may facilitate movement of laundry within the drum 28 as the drum 28 rotates.

Figure 2:
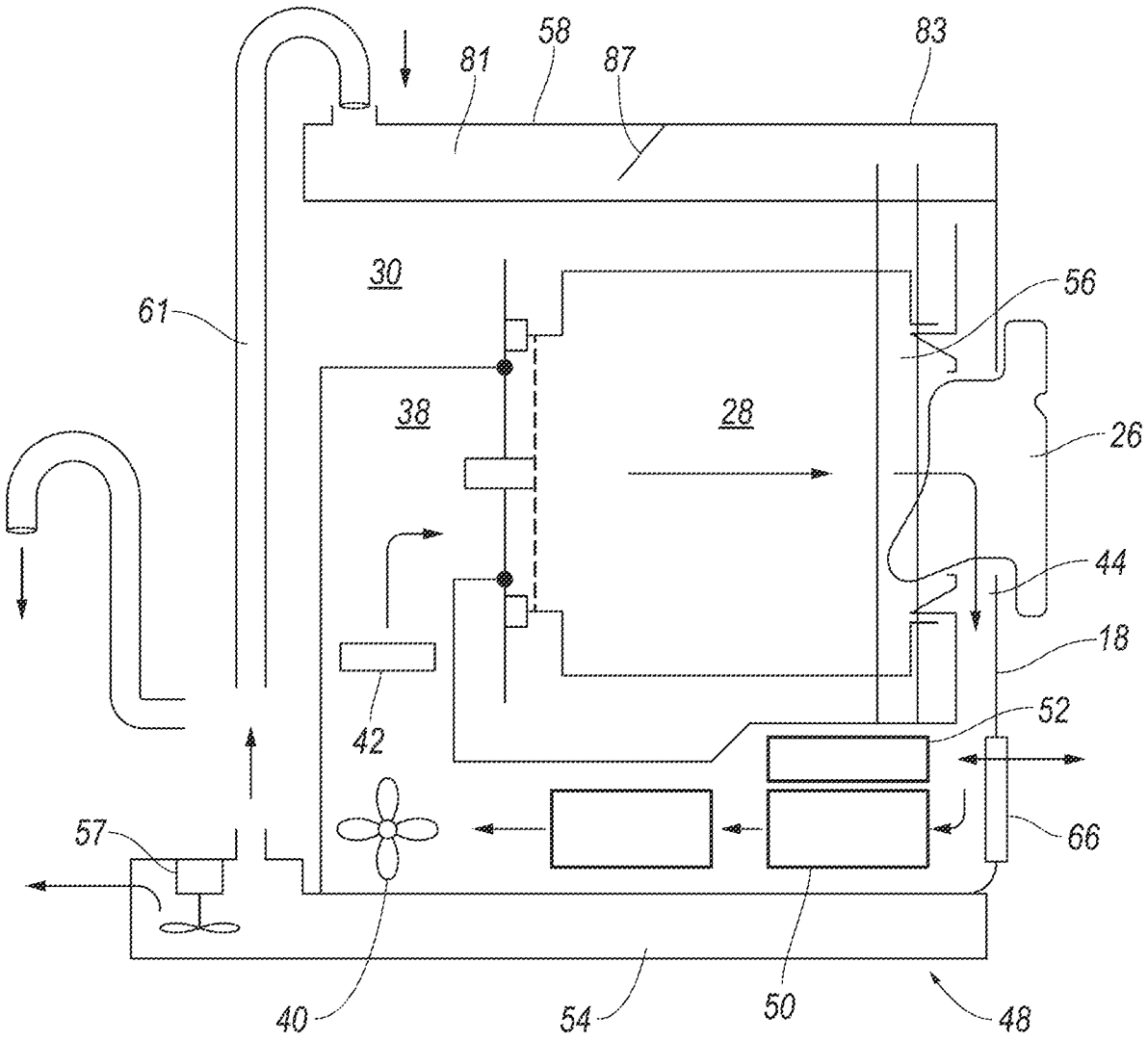
FIG. 2 is a side cross-sectional view of a schematic of the clothes dryer having a cleaning system.

FIG. 2 is a side cross-sectional view of a schematic of the clothes dryer 10 having a cleaning system 48, During a dry cycle, the clothes dryer 10 supplies air to the treating chamber 34 and then exhausts air from the treating chamber 34. The air flow system may have an air supply portion that may be formed in part by a supply air conduit 38, which has one end open to the ambient air and another end fluidly coupled to the treating chamber 34. Specifically, the supply air conduit 38 may couple with the treating chamber 34 through an inlet grill (not shown) formed in the rear bulkhead 32. A fan 40 or blower and a heater (not shown) may lie within the supply air conduit 38 and may be operably coupled to and controlled by a controller 14. If the heater is cycled on, the supplied air will be heated prior to entering the drum 28. The air supply system may further include an air exhaust portion that may be formed in part by an exhaust air conduit 44. Operation of the fan 40 draws air into the treating chamber 34 by the supply air conduit 38 and exhausts air from the treating chamber 34 through the exhaust air conduit 44. The exhaust air conduit 44 may be fluidly coupled with a household exhaust duct (not shown) for exhausting the air from the treating chamber 34 to the outside environment. This exhaust duct may be referred to herein as a vent. However, other air flow systems are possible as well as other arrangements of the fan 40 and heater 42. For example, the fan 40 may be located in the exhaust air conduit 44 instead of the supply air conduit 38.

The drum 28 may be rotated by a suitable drive mechanism, which is illustrated as a motor and a coupled belt. The motor may be operably coupled to the controller 14 to control the rotation of the drum 28 to complete a cycle of operation. Other drive mechanisms, such as direct drive, may also be used.

During use, the heated air may be used to dry the items within the drum 28. This air may collect moisture and debris, such as lint, and other particles. The exhaust air conduit 44 may house a heat exchanger 50. The heat exchanger 50 may be configured to remove condensate from air used to dry laundry within the drum 28 of the laundry appliance. The condensate may be received by a drain channel 54 arranged along the bottom of the cabinet 12. The drain channel 54 may carry excess fluid to a water drain external to the dryer 10, or to a condensate bottle 58 via a second drain channel 61. The drain channel 54 may include a drain pump 57 to pump the water to the water drain, sink, or condensate bottle 58.

The condensate bottle 58 may be arranged within or exterior to the cabinet 12 and may be configured to be selectively emptied by a user when becoming full, or near full. The condensate bottle 58 may take the form of a tradition bottle shape or may also be in a form of a container, pan, or channel, similar to that shown in FIG. 2.

The bottle 58 may include a baffle 87 to divide the container into two chambers, including a first chamber 81 and a second chamber 83. The baffle 87 may filter the residual fluid received from the drain channels 54, 61 into a clean water side and a dirty water side of the bottle 58.

A delivery channel 56 may extend from the clean water side of the condensate bottle 58 down to the heat exchanger 50. The clean water from the clean water side may be delivered via the delivery channel 56. This may allow the clean water to be reused, supplementing or replacing the use of the water supply. While a pump may be used, gravity may force the fluid down to the cleaning block 52.

The heat exchanger 50 may collect lint and other debris and eventually require cleaning due the placement within the exhaust air conduit 44, the heat exchanger 50. Thus, periodically, the heat exchanger 50 may requiring cleaning. To aid with this, a cleaning block 52 may be arranged above the heat exchanger 50 within the exhaust air conduit 44. The cleaning block 52 may be configured to provide a fluid to the heat exchanger 50 to flush the heat exchanger 50 and dislodge and remove the debris. The residual fluid may be received by the drain channel 54. The cleaning block 52 may be removable via the front wall 18 of the dryer 10. In some examples, a door may allow access to the cleaning block 52. This is described in more detail with respect to FIG. 3. In the example where the cleaning block 52 is removable, during non-use, a dead block may be arranged at the heat exchanger 50 in place of the cleaning block 52. This dead block may be removed during cleaning, to be replaced temporarily by the cleaning block 52, and returned once cleaning is complete.

The clothes dryer 10 may also have a dispensing system for dispensing treating chemistries into the treating chamber 34. The dispensing system may introduce treating chemistry into the drum 28 in any suitable manner, such as by spraying, dripping, or providing a steady flow of the treating chemistry. The treating chemistry may be in a form of gas, liquid, solid or any combination thereof and may have any chemical composition enabling refreshment, disinfection, whitening, brightening, increased softness, reduced odor, reduced wrinkling, stain repellency or any other desired treatment of the laundry. Water is one example of a suitable treating chemistry. Other non-limiting examples of suitable treating chemistries are chromophore chemistry, softening chemistry, and stain-repellency chemistry. In all cases, the treating chemistries may be composed of a single chemical, a mixture of chemicals, or a solution of water and one or more chemicals. The clothes dryer 10 may also include various dispensing units for cleaning parts or the dryer, such as the heat exchanger. Such dispensing units may include cleaning solutions to be mixed with fluid to be supplied to the heat exchanger 50.

Figure 3:
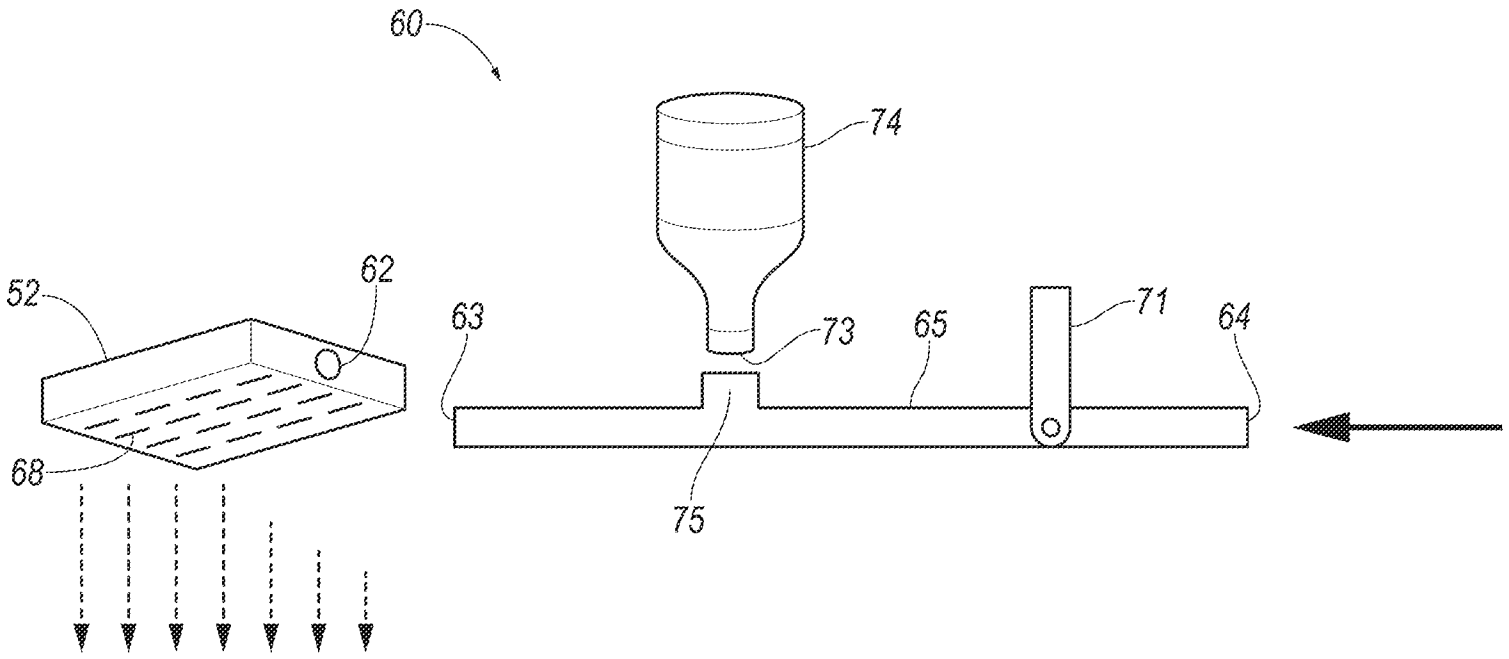
FIG. 3 is a perspective view of a cleaning device, including the cleaning block of FIG. 2, for the clothes dryer.

FIG. 3 is a perspective view of a cleaning device 60, including the cleaning block 52 of FIG. 2, for the clothes dryer 10. This device 60 may be intended to be used by a technician and may be primarily external to the dryer 10. The cleaning device 60 may include the cleaning block 52 having a hollow interior. The cleaning block 52 may be configured to receive fluid and expel that fluid via a plurality of openings 68 defined on a bottom of the cleaning block 52. While the cleaning block 52 is shown to be generally in the shape of a rectangular prism, the cleaning block 52 may form other shapes. Generally, the cleaning block 52 may have a width similar to that of the heat exchanger 50. The cleaning block 52 may allow fluid to flow through the openings 68 onto the heat exchanger 50 to flush or was the heat exchanger 50. The fluid flow may be provided at a certain pressure (e.g., 20-40 psi) to aid in dislodging debris from the heat exchanger 50. The openings 68 allow for a uniform fluid flow across the heat exchangers 50 surface to ensure sufficient cleaning.

The cleaning device 60 includes a hose 65 configured to attach to an inlet 62 of the cleaning block 52 at a first end 63 and to a water supply at the opposite second end 64. The inlet 62 of the cleaning block 52 may provide an opening to allow fluid to flow from the hose 65 into the cleaning block 52. The inlet 62 and the first end 63 may include quick-connect fittings to ease the burden on the technician during use. The water supply may be from a household water line, such a hose, or may be a stand alone water container.

The hose 65 may have a valve 71 configured to control the fluid flow to the cleaning block 52. The valve 71 may be used to control the fluid pressure at the cleaning block 52, as well as to completely turn on or turn off the fluid flow. The hose 65 may also include an inlet 73 configured to attached to a container 74 holding cleaning solution. The hose 65 may create a mixing chamber 75 therein to mix the cleaning solution with the water flow from the water supply. The inlet 73 may be a quick-connect fitting configured to interface with a container 74 containing cleaning solution. The container 74 may attach to the hose 65 via the quick-connect fitting and allow the cleaning solution to mix with the water within the hose 65. This fluid solution is then delivered to the cleaning block 52. The container 74, in one example, may include enough cleaning solution for one cleaning cycle. That is, the container 74 may be configured to a single use application and may contain a pre-measured volume of cleaning solution. In another example, a bottle cap of the container 74 may have a dosing mechanism that allows only a metered quantity of cleaning solution into the water flow.

During cleaning, the technician may first access the dead block (not shown) via a block door 66 at the front wall 18 of the dryer. The technician may remove the dead block and replace it with the cleaning block 52. The technician may then connect the second end 64 of the hose 65 with the water supply and the first end 63 of the hose 65 with the inlet 62 of the cleaning block 52. The container 74 is then connected to the inlet 73 to allow the cleaning solution to flow through the hose 65. The technician may turn on the water supply, as well as actuate the valve 71. The cleaning block 52 may then spray the mix of water and cleaning solution over the heat exchanger 50. The technician may then turn off the fluid flow via the valve 71 and allow the fluid solution to soak at the heat exchanger 50 for a certain amount of time. The technician may have access to the drain pump 57 of the dryer 10 and may actuate or turn on the drain pump 57 to remove the excess fluid and debris within the drain channel 54. This may also pump fluid through the delivery channel 56 and back onto the heat exchanger 50. This ensure that any further debris loosened by the soaking of the solution on the heat exchanger 50 are removed. The above process may be repeated during a cleaning cycle as many times as needed to ensure sufficient cleaning of the heat exchanger 50.

Figure 4:
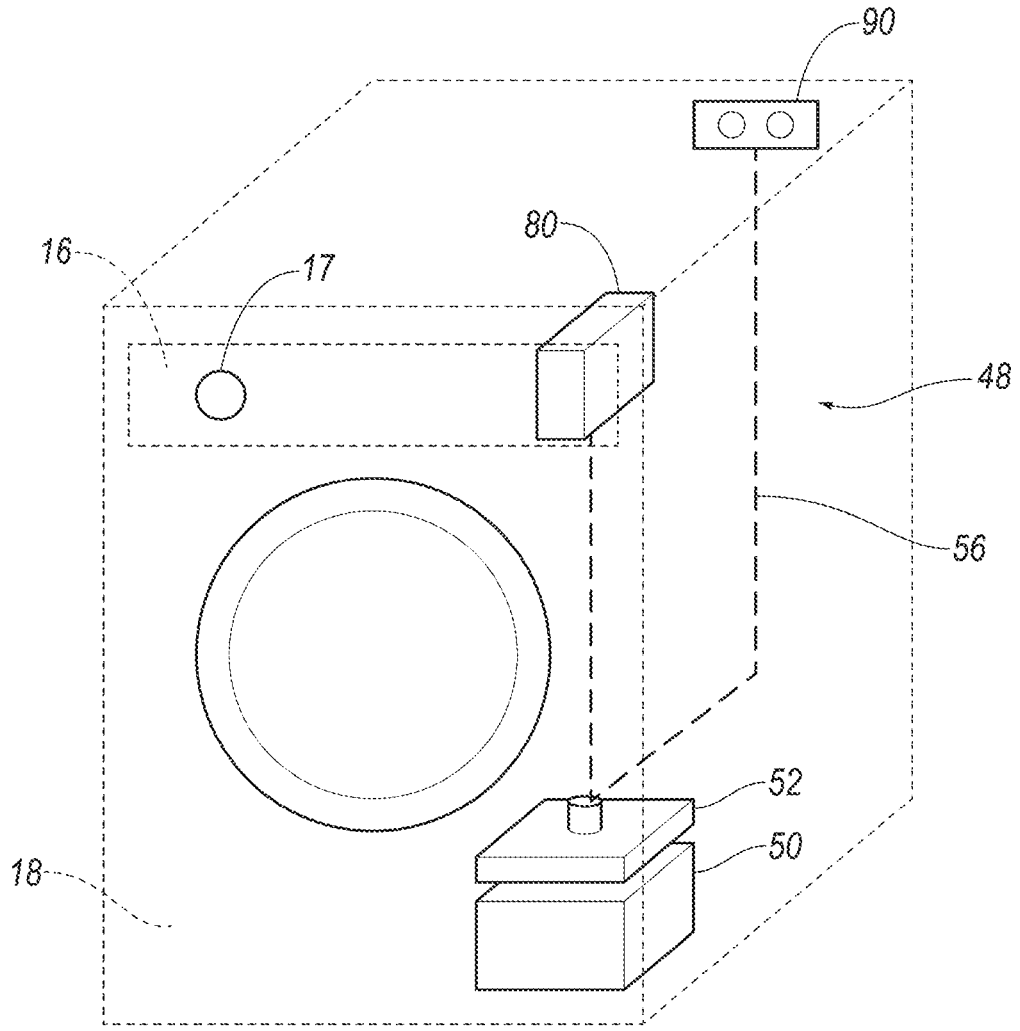
FIG. 4 is a front perspective view of a clothes dryer and at least a portion of a cleaning system.

FIG. 4 is a front perspective view of a clothes dryer 10 and at least a portion of a cleaning system 48. In this example, the cleaning system 48 may be self-contained within the dryer 10 and may not require the use of the cleaning device 60 illustrated in FIG. 3. In this example, the delivery channel 56 may be connected directly to a water source 90. Such a water source 90 may connect to the home's plumbing and may draw water therefrom. The delivery channel 56 may deliver fluid flow to the cleaning block 52 directly. The cleaning system 48 may also include a dispenser 80 configured to house cleaning solution. The dispenser 80 may include a pump (not shown) to release the solution. The cleaning solution may be delivered to a mixing chamber 82 via a solution channel 84. The cleaning solution and water from the delivery channel 56 may mix within the mixing chamber 82 prior to being delivered to the cleaning block 52. The cleaning block 52 may be formed similar to that described and shown in FIG. 3 and may provide a uniform fluid flow to the heat exchanger 50 for cleaning. Although not specifically shown in FIG. 4, the cleaning system 48 may include a drain channel, pump, etc., similar to FIG. 2. In this example, the cleaning block 52 may be fixed above the heat exchanger 50.

The dispenser 80 may be accessible via the front wall 18 of the dryer 10 and may be refillable, similar to a detergent dispenser. The front wall 18 may also include the user interface 16 as described previously. A special cleaning cycle button 17 may be included. This may allow for a user to easily select the cleaning cycle, and also provide notice that a cleaning cycle is available.

Figure 5:
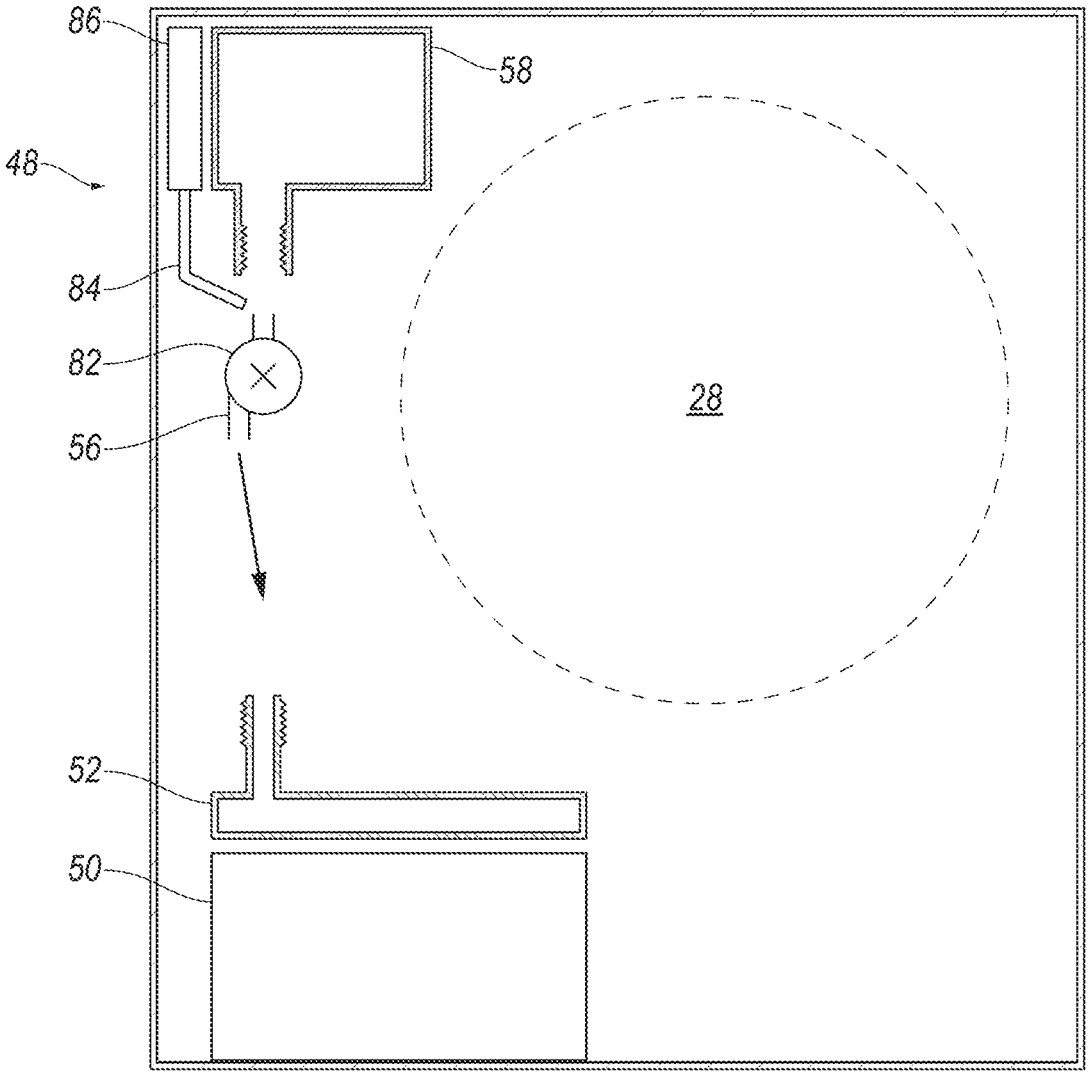
FIG. 5 is a side cross-sectional view of a clothes dryer and at least a portion of a cleaning system.

FIG. 5 is a side cross-sectional view of a clothes dryer 10 and at least a portion of a cleaning system 48. The cleaning system 48 in FIG. 5 may include the bottle 58 configured to hold condensate. The condensate may be used as a water supply for the cleaning system 48. In this example, the dispenser 86 may be arranged adjacent to the bottle 58. The dispenser 86 may be external to the cabinet 12, or may be internal, similar to the example in FIG. 4. The cleaning solution may be delivered to a mixing chamber 82 via a solution channel 84. In this example, the mixing chamber 82 may be arranged on the delivery channel 56. The cleaning solution and water from the delivery channel 56 may mix within the mixing chamber 82 prior to being delivered to the cleaning block 52. The cleaning block 52 may be formed similar to that described and shown in FIG. 3 and may provide a uniform fluid flow to the heat exchanger 50 for cleaning. Although not specifically shown in FIG. 4, the cleaning system 48 may include a drain channel, pump, etc, similar to FIG. 2.

Figure 6:
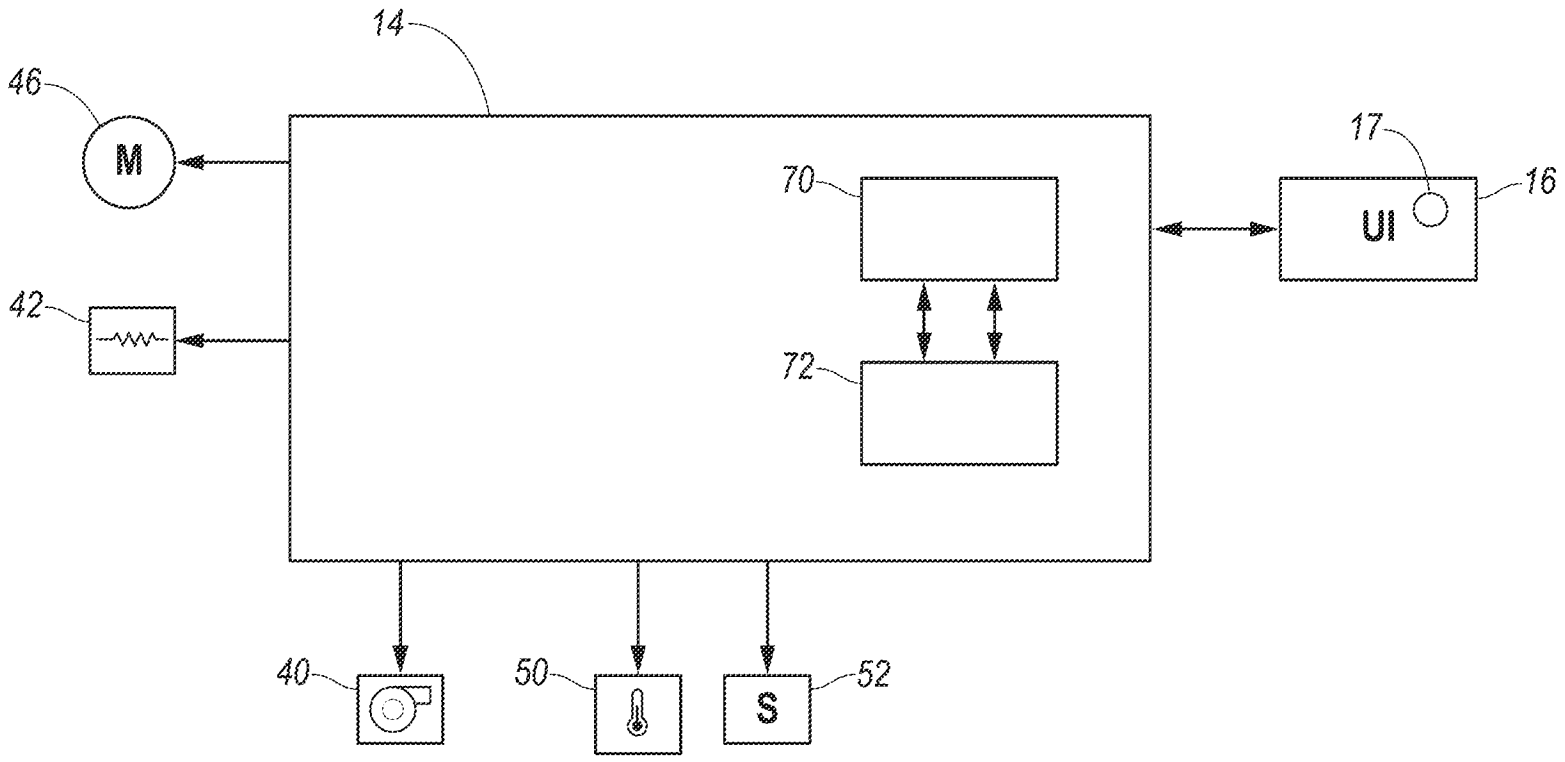
FIG. 6 is a block diagram of a control system for controlling the cleaning system.

FIG. 6 is a block diagram of a control system for controlling the cleaning system 48 and may include the controller 14. The controller 14 may be provided with a memory 70 and a central processing unit (CPU) 72. The memory 70 may be used for storing the control software that may be executed by the CPU 72 in completing a cycle of operation using the clothes dryer 10 and any additional software. The memory 70 may also be used to store information, such as a database or table, and to store data received from the one or more components of the clothes dryer 10 that may be communicably coupled with the controller 14.

The controller 14 may be operably coupled with one or more components of the clothes dryer 10 for communicating with and/or controlling the operation of the component to complete a cycle of operation. For example, the controller 14 may be coupled with the fan 40 and the heater 42 for controlling the temperature and flow rate of the air flow through the treating chamber 34; the motor 46 for controlling the direction and speed of rotation of the drum 28; and the user interface 16 for receiving user selected inputs and communicating information to the user. The controller 14 may also receive input from various additional sensors, which are known in the art and not shown for simplicity. Non-limiting examples of additional sensors that may be communicably coupled with the controller 14 include: a treating chamber, a temperature sensor, a supply air flow temperature sensor, a moisture sensor, an air flow rate sensor, a weight sensor, and a motor torque sensor.

The controller 14 may further be configured to implement the cleaning cycle. This may be automatically initiated based on a trigger event. Such trigger events may include a predetermined amount of time has been exceeded, a predetermined amount of dry cycles have been completed, detection that the condensate bottle is full, receiving user initiated instructions at the user interface 16, or otherwise (e.g., via mobile device). The trigger event may include more than one event. For example, in the example where the condensate bottle is full, the trigger event may include that the bottle is full and that a predetermined amount of time has been exceeded. This may prevent the cleaning cycle from being initiated every time that the bottle is determined to be full. Other examples to balance the cleaning cycle may also be appreciated. In addition to running the cleaning cycle in response to a trigger event, the controller 14 may instruct for an alert in response to one or more of the trigger events. For example, a light or message may be displayed on the user interface 16 to indicate that the cleaning cycle should be activated at the user interface 16. An alert may be pushed to the user's mobile device. In the example where the cleaning system 48 is not fully integrated into the dryer 10, the technician may be alerted in response to one or more of the trigger events.

Figure 7:
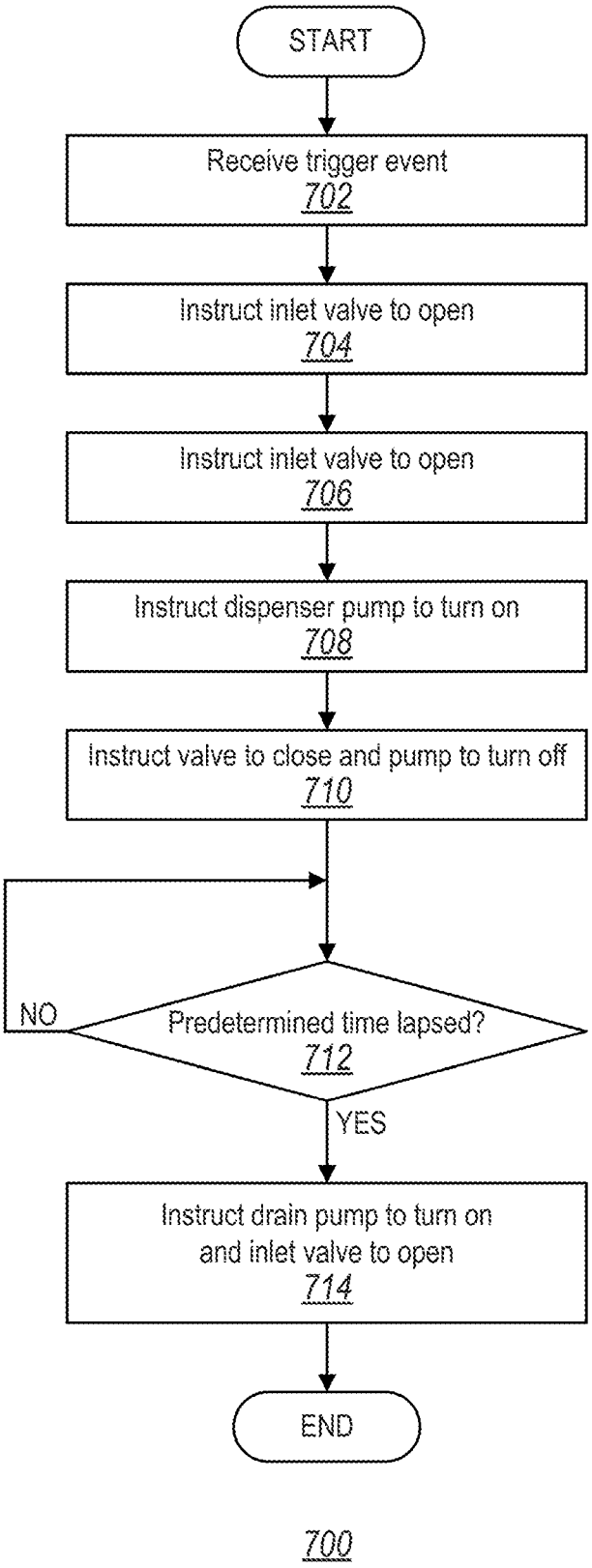
FIG. 7 is an example process for the cleaning system.

FIG. 7 is an example process 700 for the cleaning system 48 where the cleaning system is integrated into the dryer 10 and includes a water source 90, as illustrated by way of example in FIG. 4 and components of which are illustrated in FIG. 3. The process 700 may be carried out by instructions provided by the controller 14 of FIGS. 1 and 6. However, other controllers or processors may carry out instructions, including those remote from the dryer 10. The process 700 may begin at block 702 where the controller 14 receives a trigger event. As explained above, the trigger event may be initiation of the cleaning cycle in response to user input (e.g., at button 17, via selection from a mobile device, etc.) or in response to a passive event such as exceeding a predetermined amount of time (e.g., four months), exceed a predetermined count (or hours of operation) of drying cycles (e.g., 200), etc.

At block 704, the controller 14 may instruct the inlet valve 85 on the delivery channel 56 to open, allowing water from the water source 90 to enter the delivery channel 56.

At block 708, the controller 14 may instruct the pump for the dispenser 80 to turn on, allowing the cleaning solution to be dosed into the water stream. The solution then enters the cleaning block 52 and sprays the heat exchanger 50.

At block 710, the controller 14 may instruct the valve 85 to close and the pump of the dispenser to turn off.

At block 712, the controller 14 determine if a predetermined amount of time has passed since the valve 85 was opened. This predetermined amount of time may relate to an appropriate time for the heat exchanger 50 to "soak" after being sprayed with the solution. In one example, this may be five minutes. Once the predetermined amount of time has lapsed, the process 700 proceeds to block 714.

At block 714, the controller 14 may instruct the drain pump 57 to turn on and an inlet valve to open, allowing water to spray over the heat exchanger 50 to remove debris loosened by the soaking of the solution.

In the example of an integrated cleaning system 48 which uses a condensate bottle 58, as illustrated by way of example in FIG. 5, and partially in FIG. 2, the process may be similar to the process 700, except the user may be required to fill the bottle with water prior to cleaning and after cleaning, the residual fluid may be pumped back into the bottle, which the user may then be required to drain.

The processes, methods, or algorithms disclosed herein can be deliverable to/implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information permanently stored on non-writable storage media such as read-only memory (ROM) devices and information alterably stored on writeable storage media such as floppy disks, magnetic tapes, compact discs (CDs), random access memory (RAM) devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to strength, durability, life cycle, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

The abstract of the disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A laundry appliance, comprising:

a blower configured to deliver exhausted air through an airflow path;

a heat exchanger arranged within the airflow path and configured to dehumidify the exhausted air;

a drain channel configured to receive condensate from the heat exchanger;

a cleaning block arranged above the heat exchanger and configured to deliver fluid flow over the heat exchanger to clean the heat exchanger, wherein the drain channel is configured to receive residual fluid and debris created from the fluid flow over the heat exchanger, and further comprising a drain pump configured to remove the residual fluid and debris from the drain channel; and a condensate bottle separate and distinct from the drain channel configured to receive the residual fluid and debris from the drain channel.

2. The appliance of claim 1, wherein the cleaning block defines a plurality of openings configured to create a uniform fluid flow over the heat exchanger.

3. The appliance of claim 1, wherein the cleaning block is configured to receive fluid comprising water and cleaning solution.

4. The appliance of claim 1, further comprising a delivery channel extending between the condensate bottle and the cleaning block and configured to deliver recycled fluid from the condensate bottle to the cleaning block to further provide fluid flow to the heat exchanger for further cleaning.

5. The appliance of claim 4, wherein the recycled fluid is clean water and wherein the condensate bottle includes a baffle dividing the condensate bottle into at least two chambers, a first chamber configured to collect the debris from the drain channel and a second chamber configured to collect the clean water to deliver to the heat exchanger for further cleaning.

6. The appliance of claim 5, further comprising a dispenser configured to house cleaning solution and arranged adjacent the condensate bottle; and a mixing chamber configured to receive the cleaning solution from the dispenser and clean water from the condensate bottle to provide the cleaning solution to the cleaning block.

7. The appliance of claim 1, further comprising a delivery channel extending between a water source and the cleaning block and configured to deliver water from the water source to the cleaning block to further provide fluid flow to the heat exchanger for further cleaning.

8. The appliance of claim 7, further comprising a dispenser arranged downstream from the water source, the dispenser configured to house cleaning solution to be mixed with the water from the water source prior to being delivered to the cleaning block.

9. The appliance of claim 1, wherein the cleaning block is selectively removable at a front wall of the appliance.

10. A laundry appliance, comprising:

a blower configured to deliver exhausted air through an airflow path;

a heat exchanger arranged within the airflow path and configured to dehumidify the exhausted air;

a drain channel configured to receive condensate from the heat exchanger;

a cleaning block arranged above the heat exchanger and configured to deliver fluid flow over the heat exchanger to clean the heat exchanger, wherein the drain channel is configured to receive residual fluid and debris created from the fluid flow over the heat exchanger, and further comprising a drain pump configured to remove the residual fluid and debris from the drain channel; and a condensate bottle separate and distinct from the drain channel configured to receive the residual fluid and debris from the drain channel;

a delivery channel extending between the condensate bottle and the cleaning block and configured to deliver recycled fluid from the condensate bottle to the cleaning block to further provide fluid flow to the heat exchanger for further cleaning;

a dispenser configured to house cleaning solution and arranged adjacent the condensate bottle; and a mixing chamber configured to receive the cleaning solution from the dispenser and clean water from the condensate bottle to provide the cleaning solution to the cleaning block.

* * * * *